US009903086B2

(12) United States Patent
Queen

(10) Patent No.: US 9,903,086 B2
(45) Date of Patent: Feb. 27, 2018

(54) FRICTION REDUCTION PILE JACKET WITH SLIP ADDITIVE

(71) Applicant: Foundation Technologies, Inc., Lawrenceville, GA (US)

(72) Inventor: Frankie A. R. Queen, Dacula, GA (US)

(73) Assignee: Foundation Technologies, Inc., Lawrenceville, GA (US)

( * ) Notice: Subject to any disclaimer, the term of this patent is extended or adjusted under 35 U.S.C. 154(b) by 0 days.

(21) Appl. No.: 14/801,460

(22) Filed: Jul. 16, 2015

(65) Prior Publication Data

US 2017/0016197 A1 Jan. 19, 2017

(51) Int. Cl.

| | |
|---|---|
| ***E02D 5/60*** | (2006.01) |
| ***E02D 5/22*** | (2006.01) |
| ***E02D 7/00*** | (2006.01) |
| ***E02D 27/12*** | (2006.01) |

(52) U.S. Cl.

CPC ..... *E02D 5/60* (2013.01); *E02D 5/226* (2013.01); *E02D 7/00* (2013.01); *E02D 27/12* (2013.01)

(58) Field of Classification Search

CPC .. E02D 5/60; E02D 5/226; E02D 7/00; E02D 27/12

See application file for complete search history.

(56) References Cited

U.S. PATENT DOCUMENTS

| | | | |
|---|---|---|---|
| 1,709,893 | A | 4/1929 | Bemis |
| 1,947,413 | A | 2/1934 | Hay |
| 2,706,498 | A | 4/1955 | Upson |
| 2,928,411 | A | 3/1960 | Johnson |
| 3,141,306 | A | 7/1964 | Liddell |
| 3,166,871 | A | 1/1965 | Simison |

(Continued)

FOREIGN PATENT DOCUMENTS

| | | |
|---|---|---|
| FR | 1173701 | 3/1959 |
| JP | 60-223521 | 11/1985 |
| WO | 2004001139 | 12/2003 |

OTHER PUBLICATIONS

A. Schulman Inc.; Article entitled: "Additive Slip", located at <http://www.aschulman.com/Americas/Masterbatch/CategoryPlusFunctionality/84096/33/Additive-Slip.aspx>, Accessed on Nov. 5, 2014, 2 pgs.

(Continued)

*Primary Examiner* — Tara M. Pinnock

(74) *Attorney, Agent, or Firm* — Taylor English Duma LLP

(57) ABSTRACT

A friction reducing jacket is applied to a pile. The jacket comprises a sheet material and is formed in a shape that can conform to the exterior surface of the pile. The sheet material comprises a thermoplastic, e.g., polyolefin, and a slip agent, e.g., amide. A method of shielding a pile from downward force exerted by backfilled earthen materials during settlement includes the steps of providing a friction reducing jacket constructed of sheet material comprising a thermoplastic polymer and an amide slip agent; driving the pile into soil, leaving a portion of the pile above the soil exposed; wrapping the friction reducing jacket around the exterior surface of the exposed portion of the pile such that the interior surface of the jacket contacts the exposed exterior surface of the pile; and placing backfilled earthen materials around the jacketed section of the pile.

15 Claims, 2 Drawing Sheets

(56) References Cited

U.S. PATENT DOCUMENTS

| | | | | |
|---|---|---|---|---|
| 3,176,021 | A * | 3/1965 | Volungis | C08K 5/20 524/231 |
| 3,327,441 | A | 6/1967 | Kelley | |
| 3,352,120 | A | 11/1967 | Pelzer | |
| 3,403,520 | A | 10/1968 | Goodman | |
| 3,487,646 | A | 1/1970 | Gatier | |
| 3,495,565 | A | 2/1970 | Gustavii | |
| 3,963,056 | A | 6/1976 | Shibuya et al. | |
| 3,981,038 | A | 9/1976 | Vidal | |
| 4,019,301 | A | 4/1977 | Fox | |
| 4,069,677 | A | 1/1978 | Yamada et al. | |
| 4,081,941 | A | 4/1978 | Van Ausdall | |
| 4,114,388 | A | 9/1978 | Straub | |
| 4,119,511 | A | 10/1978 | Christenson | |
| 4,157,287 | A | 6/1979 | Christenson | |
| 4,347,019 | A | 8/1982 | Metz | |
| 4,386,876 | A | 6/1983 | Dupeuble | |
| 4,397,589 | A | 8/1983 | Darroussin et al. | |
| 4,464,083 | A | 8/1984 | Wathey | |
| 4,510,281 | A * | 4/1985 | Smith | C08K 5/20 524/229 |
| 4,585,681 | A | 4/1986 | Kidera et al. | |
| RE32,325 | E * | 1/1987 | Smith | C08K 5/20 524/229 |
| 4,721,418 | A | 1/1988 | Queen | |
| 4,818,148 | A | 4/1989 | Takeda et al. | |
| 5,145,284 | A | 9/1992 | Hulett et al. | |
| 5,213,166 | A | 5/1993 | Watanabe et al. | |
| 5,226,751 | A | 7/1993 | Doleshal | |
| 5,333,971 | A | 8/1994 | Lewis | |
| 5,763,047 | A | 6/1998 | Green | |
| 5,931,604 | A | 8/1999 | Queen | |
| 6,234,720 | B1 | 5/2001 | Queen | |
| 6,471,446 | B2 | 10/2002 | Queen | |
| 6,593,280 | B2 | 7/2003 | Matsunaga et al. | |
| 6,616,381 | B2 * | 9/2003 | Larsen, Jr. | E02D 27/35 405/229 |
| 2007/0203273 | A1 * | 8/2007 | Van Riel | C08L 23/10 524/232 |

OTHER PUBLICATIONS

Article entitled: "Slip Additives", Ampacet Managing the Elements of Success; Technical Service Report; Publicly available prior to Jul. 16, 2015, 3 pgs.

CRODA; Article entitled: "Crodamide slip & anti-block for easier processing & handling of polyolefins", CRODA Polymer Additives; Publicly available prior to Jul. 16, 2015, 6 pgs.

Queen, Frankie A.R.; Applicant Interview Summary for U.S. Appl. No. 06/941,770, filed Dec. 15, 1986, dated Jun. 11, 1987, 4 pgs.

Queen, Frankie A.R.; Non-Final Office Action for U.S. Appl. No. 08/982,854, filed Dec. 2, 1997, dated Oct. 8, 1998, 21 pgs.

Queen, Frankie A.R.; Non-Final Office Action for U.S. Appl. No. 09/353,760, fiiled Jul. 14, 1999, dated Sep. 5, 2000, 5 pgs.

Queen, Frankie A.R.; Notice of Allowance for U.S. Appl. No. 06/941,770, filed Dec. 15, 1986, dated Aug. 27, 1987, 10 pgs.

Queen, Frankie A.R.; Non-Final Office Action for U.S. Appl. No. 06/941,770, filed Dec. 15, 1986, dated Mar. 17, 1987, 5 pgs.

Queen, Frankie A.R.; Notice of Allowance for U.S. Appl. No. 08/982,854, filed Dec. 2, 1997, dated Mar. 15, 1999, 16 pgs.

Queen, Frankie A.R.; Notice of Allowance for U.S. Appl. No. 09/353,760, fiiled Jul. 14, 1999, dated Jan. 2, 2001, 3 pgs.

Queen, Frankie A.R.; Notice of Allowance for U.S. Appl. No. 09/863,633, filed May 21, 2001, dated Jul. 16, 2002, 4 pgs.

Sherman, Lilli; Article entitled: "Get the Right Additives for mLLDPE Film", Plastics Technology Jul. 2000, located at <http://www.ptonline.com/articles/get-the-right-additives-for-mlldpe-film>, Accessed on Nov. 5, 2014, 5 pgs.

Proceedings International Conference on Design and Construction of Deep Foundations, vol. II, Sessions 1 through 4, Dec. 1994, 15 pgs.

* cited by examiner

FRICTION REDUCTION PILE JACKET WITH SLIP ADDITIVE

TECHNICAL FIELD

This disclosure relates generally to pile supports for bridges and other structures, wherein the piles are driven into the earth and backfilled earthen materials and the like are placed about the pile. More specifically, this disclosure relates to an improved friction reduction pile jacket placed about the pile which reduces and remediates the downward-settling forces of the settling backfilled earthen materials from applying an adverse downward load to a pile.

BACKGROUND

In the construction of bridges and other structures in which pile supports are driven into the earth and are used as supports for the bridge, etc., it is common to form abutment walls about the piles and to backfill the space between abutment walls and the piles with backfilled earthen materials and other materials. For example, U.S. Pat. No. 3,981,038 discloses a backfilled barrier wall formed of panels mounted one upon the other and held together with elongated reinforcing straps. As the wall is constructed, the backfilled earthen material is placed in layers beside the wall about the supporting piles of the bridge abutment. These constructions are referred to in the industry as Mechanically Stabilized Earth (MSE) wall structures.

One of the problems encountered with bridges and other structures supported by piles with backfilled earthen materials placed about the piles is that the backfilled earthen materials placed about the pile tend to settle over a length of time, and the downward movement of the backfilled earthen materials applies an adverse downward load to the piles. The surface friction created by the settling of the backfilled earthen materials in contact with the surface facing of the piles tends to transmit a substantial amount of adverse vertical load to the pile. This load tends to adversely affect the piles, sometimes causing enough stress that the piles may bend or otherwise become deformed, affecting the integrity of the structure supported.

One technique for avoiding the application of the downward force from the backfill material against piles is to surround the piles with metal or plastic conduits prior to the backfilled earthen material being placed about the piles and to fill the tubes with sand, or the like. As a result, the downward settling movement of the backfilled earthen material is applied to the exterior surfaces of the conduit in lieu of the exterior surfaces of the pile. This technique generally protects the pile from the downward forces of the backfill earth.

While the aforementioned conduit and sand technique has been successful in avoiding adverse effects on bridge abutment piles, etc., due to the downward weight applied by the settling backfilled earthen materials, the use of the conduits and sand utilizing this technique is expensive in that the materials are relatively expensive, and the labor required to telescopically mount the conduits over the piles and then to fill the conduits with sand is expensive.

One technique for overcoming the aforementioned limitations is disclosed in U.S. Pat. No. 4,721,418, in which a pile jacket, formed of laminated sheet material, such as polyethylene, is placed about a pile. When the load or weight of the backfilled earthen material tends to settle, it tends to move the pile jacket downwardly with respect to the pile, with the interfacing surfaces of the pile and the pile jacket forming a slip plane. In this manner, the jacket shields the pile from the downward force exerted by the downwardly-moving backfill material during settlement. The patent discloses that a worker could coat either the outer surfaces of the pile, or the inner surfaces of the pile jacket, with a lubricant, such as grease, to reduce the friction within the slip plane. However, in practice, it has been found that grease or other lubricants attract debris during pile settlement, thereby actually increasing the friction within the slip plane. A drawback of the '418 pile jacket relates to the manufacture of the sheet material for the pile jacket. Polyolefin films exhibit a high degree of tackiness in their natural state. This tackiness creates a problem during the manufacturing process.

It is well known that certain polymers and additives can serve to reduce both static and dynamic coefficients of friction greatly. A sheet or spray coating of PTFE (poly tetra fluoro ethylene) possesses one of the lowest coefficients of friction known. Recently, it has been shown proven that diamonds covered with a graphene sheet has the lowest measured coefficient of friction. However; these techniques are more expensive and impractical to use. History has proven the need to work within practical and economic boundaries in most applications.

The need persists in the art for an improved pile jacket.

SUMMARY

Disclosed is a friction reducing jacket for application to a pile including an exterior surface and a substantially uniform cross sectional shape along its length, the jacket constructed of sheet material surrounding the pile and formed in a shape conforming to the exterior surface of the pile, the sheet material comprising a thermoplastic polymer and a slip agent. The slip agent can comprise an amide. The slip agent can be a migrating slip agent.

Also disclosed is a method of shielding a pile from downward force exerted by backfilled earthen materials during settlement, the pile including an exterior surface and a substantially uniform cross sectional shape along its length, including the steps of providing a friction reducing jacket constructed of sheet material formed in a shape conforming to the exterior surface of the pile, the sheet material comprising a thermoplastic polyolefin and an amide slip agent; driving the pile into soil, leaving a portion of the pile above the soil exposed, thereby defining an exposed portion of the pile; wrapping the friction reducing pile jacket around the exterior surface of the exposed portion of the pile such that the interior surface of the jacket contacts the exposed exterior surface of the pile, thereby forming a jacketed section of the pile; and placing backfilled earthen materials around the jacketed section of the pile.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a friction reduction pile jacket and associated methods, systems, devices, and various apparatus. The pile jacket includes a sheet of thermoplastic, e.g., polyolefin, material comprising a slip agent, such as an amide. It would be understood by one skilled in the art that the disclosed pile jacket is described in but a few exemplary embodiments among many. No particular terminology or description should be considered limiting on the disclosure or the scope of any claims issuing therefrom.

Figure 1:
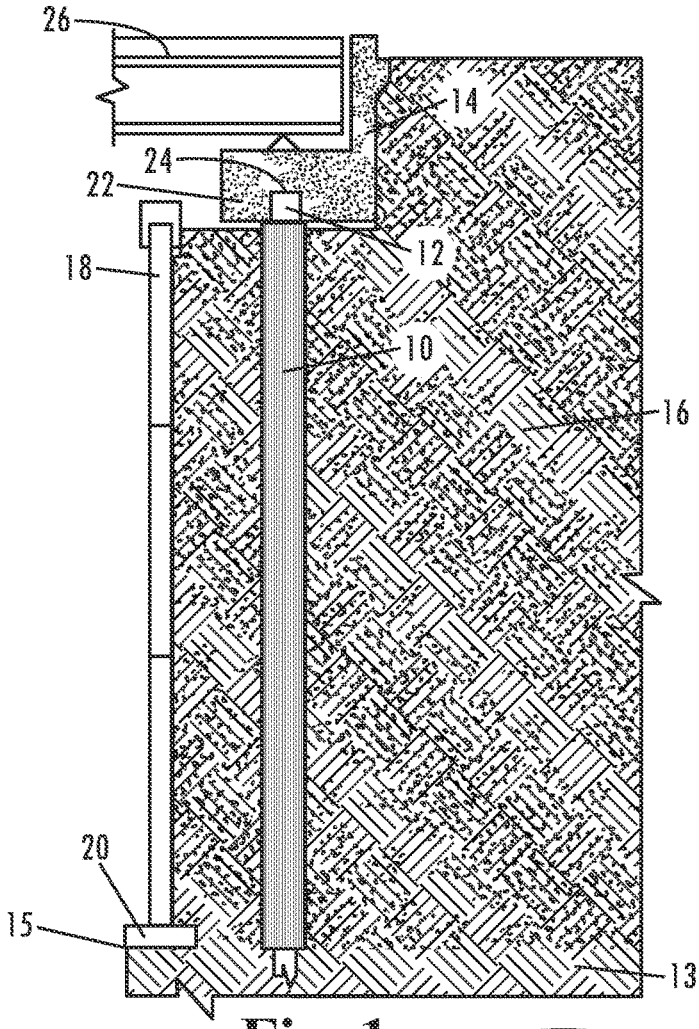
FIG. 1 is a side view of a bridge abutment structure, with parts broken away to show a pile, and an associated friction reduction pile jacket constructed in accordance with the present invention, surrounded by backfilled earthen materials and positioned behind a mechanically stabilized earth wall.

One embodiment of a friction reduction pile jacket is disclosed and described in FIG. 1, which illustrates a friction reduction pile jacket 10 surrounding at least a portion of a pile 12 that is driven into soil 13 and that supports a structure such as a bridge abutment 14. The pile 12 and jacket 10 are shown surrounded by backfilled earthen materials 16 and positioned behind a mechanically stabilized earth ("MSE") wall 18, supported by a leveling pad (footing) 20 resting at grade level 15. The backfilled earthen materials 16 can be comprised of variable soil types, and usually will be of graded uniform granular materials. The pile 12 can be driven into the soil 13, for example, directly behind a MSE wall 18 to be built and positioned beneath a bridge abutment concrete pile cap 22 within which the top end 24 of the pile 12 will be encapsulated. Pile 12 can be driven by means of power actuated pile drivers into the soil 13 to a depth that possess sufficient strength capable of receiving the transferred structural loads imposed through and by the structure, e.g., bridge abutment 14 in support of a bridge structure 26.

The pile 12 is sized to accommodate the load transferred from the structure it supports, e.g., bridge abutment 14. The backfilled earthen materials 16 impose a direct surcharge load upon the soil 13. Due to this surcharge load, the soil 13 beneath is compressed, resulting in settlement of the construction materials and the backfilled earthen materials 16. The settlement of the backfilled earthen materials 16 causes downdrag forces upon the pile 12. This downdrag load is also sometimes referred to as negative skin friction and requires remedial efforts to mitigate its effects. The downdrag load is mitigated by placing the pile jacket 10 around the driven pile 12 during construction, in the manner discussed below.

Figure 2A:
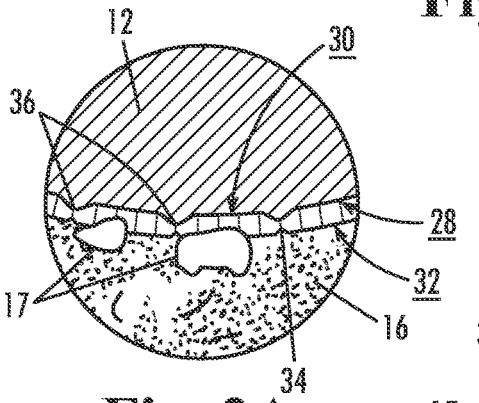
FIG. 2A is an enlarged sectional view of the section of the pile and friction reduction pile jacket called out in FIG. 2.
Figure 2:
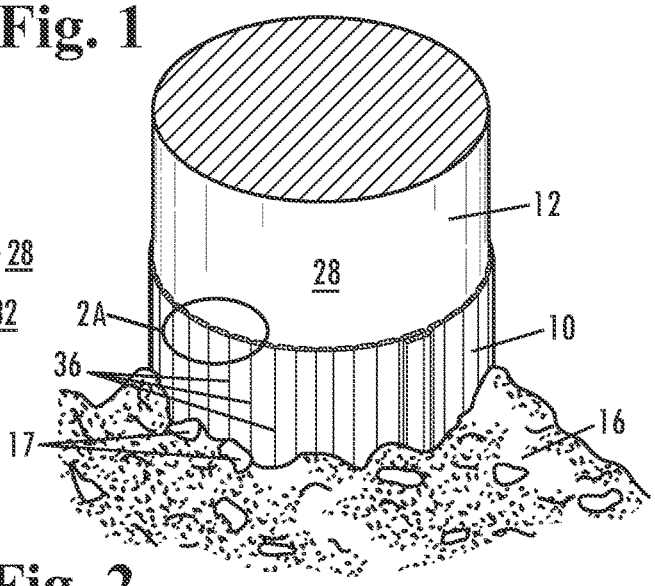
FIG. 2 is a perspective view of a pile and friction reduction pile jacket constructed in accordance with an embodiment of the present invention, both partially embedded in backfilled earthen materials.
Figure 3:
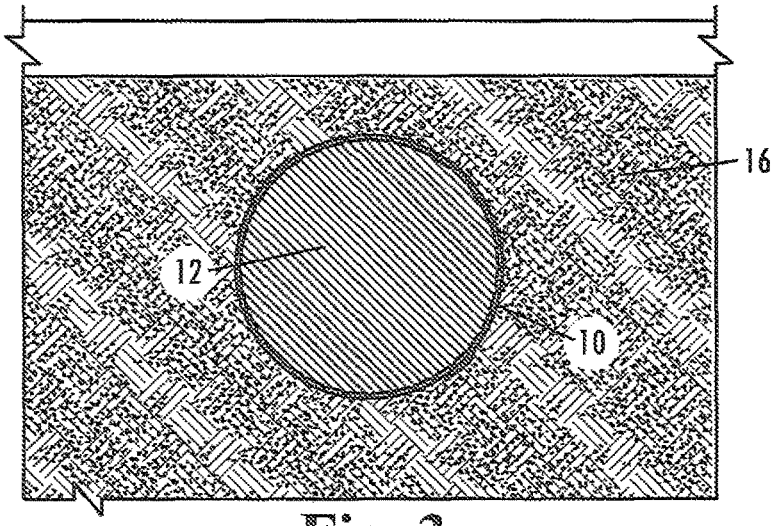
FIG. 3 is a horizontal cross-sectional view showing a jacketed pile embedded within backfilled earthen materials.

Referring to FIGS. 2 and 2A in conjunction with FIG. 1, driving the pile 12 into the soil 13 leaves a portion of the pile 12 above the soil 13 exposed, defining an exposed portion of the pile 12, shown in FIG. 2 as having an exterior pile surface 28, which is usually substantially smooth. The friction barrier pile jacket 10 is wrapped around the exterior pile surface 28 such that the interior surface 30 (shown in FIG. 2A) of the jacket 10 contacts the exterior pile surface 28, thereby forming a jacketed section of the pile 12. To completely cover the exposed portion of the cylindrical pile 12, multiple scores are placed along the longitudinal direction of the pile jacket section 10 and wrapped around the exposed portion of the pile 12 and are sequentially affixed over and around each preceding section placed around the pile 12, in conjunction with, and in corresponding lifts of, the backfilled earthen materials 16 as they are placed and compacted around the jacketed section of pile 12. The backfilled earthen materials 16 are then placed around the pile jacket 10 (as shown in FIG. 3) and compacted. Material within the backfilled earthen materials 16, including aggregate 17, grips the exterior surface 32 of the pile jacket 10, forming indentations 34 in that surface 32. Yet, the interior surface 30 of the pile jacket 10 will not be subject to the same deformation as the exterior surface 32, owing to the spacer structure inside the pile jacket sheet, as detailed in U.S. Pat. No. 4,721,418, the disclosure of which is hereby incorporated by reference in its entirety. The grip exerted on the jacket exterior surface 32 by the backfilled earthen materials 16 results in a coefficient of sliding friction between the backfilled earthen materials 16 and the exterior surface 32 that is larger than a coefficient of sliding friction between the interior surface 30 of the pile jacket 10 and the exterior pile surface 28, such that downward forces applied by settlement of the backfilled earthen materials 16 tend to move the pile jacket 10 downwardly about the pile 12 substantially without transmitting a major portion of the downward forces to the pile 12. This results in a slip plane effect between the settling backfilled earthen materials 16 and the pile 12.

Again referring to FIGS. 2 and 2A, it is desirable to increase the interior contact surface area of a cylindrical pile jacket 10 that will come into contact with the exterior pile surface 28 in order to enhance the friction reduction capabilities of the pile jacket 10. This is accomplished by utilizing multiple scores 36 formed into the interior surface 30 of pile jacket 10. The scores are formed during the fabrication process by dull knife blades on rollers or bars placed into a jig that make indentations against the longitudinal length of one side of the sheet material comprising pile jacket 10 in order to weaken that side, thus allowing the sheet to fold and bend in a predetermined manner. The multiple scoring process provides a way for the pile jacket 10 to bend and better conform around the exterior circumference of the pile 12 for a more uniform contact surface between the pile jacket 10 and the pile 12, thus providing an increased friction reduction component. The number of scores are determined by considering factors such as the shape of the pile to be jacketed to achieve a desired level of surface contact between the pile jacket and a pile, and the thickness, size, and type of material to be scored to fit best about a cylindrical pile. It has become apparent through application testing that the best results are achieved utilizing thinner core materials with a greater proportion of longitudinal scoring for this application.

The sheet of thermoplastic material can be comprised of a polyolefin. A polyolefin material comprising the pile jacket 10 is preferably polypropylene. A commercially available suitable polypropylene sheet material is from Corex Plastics Pty, Ltd. of Victoria, Australia. However, other embodiments of the present invention can use polyolefins other than polypropylene. For example, the sheet could be constructed of polyethylene instead of polypropylene. The polyolefin can be virgin or recycled materials so long as the resulting jacket has the desired coefficient of friction properties and no detrimental properties for the jacket's end use. It has been proven in application, that polypropylene performs best, because it is easy to produce, it is higher purity, has a lower melting point, greater stiffness, it has better resistance to cracking, is lighter weight, and has high resistance to chemicals including acids and organic solvents. One of ordinary skill in the art can determine an appropriate polymeric material for construction of the pile jacket.

The coefficient of sliding friction within the slip plane defined between the interior surface 30 of the pile jacket 10 and the exterior pile surface 28 is dramatically reduced when the pile jacket 10 is fabricated with improved friction reduction additives. It has been found that by introducing certain quantities of slip agent additives, such as amide agents, greater friction reduction can be achieved between an, e.g., extruded polypropylene pile jacket 10 comprising an amide slip agent and a driven pile 12 in order to enhance downdrag reduction, as compared to pile jackets heretofore used.

Polyolefin films exhibit a degree of tackiness in their natural state. This tackiness creates a problem during the manufacturing process. In order to improve the material's ability to separate and slide during manufacturing, slip additives have been introduced to enhance this capability. Slip additives are used to resist the friction of the polymer material sliding over itself and over parts of the manufacturing equipment during the manufacturing process. Slip additives can be comprised of amides. Common types of amide slip agents are oleamide and erucamide additives, although other amides can be used. Preferred slip agents include migratory slip agents.

Effectiveness of these slip additives is normally determined by the coefficient of friction (COF) it allows. The COF is usually measured using a Standard Method of Testing, ASTM D-1894. COF is a ratio of the force required to slide one layer of material across another relative to the gravimetric force exerted upon it. A similar method of testing, described in the Example below, has shown that the same slip additive will improve the COF results in sliding over other substrates such as steel and concrete in a much similar manner resulting in enhanced material performance.

Figure 4:
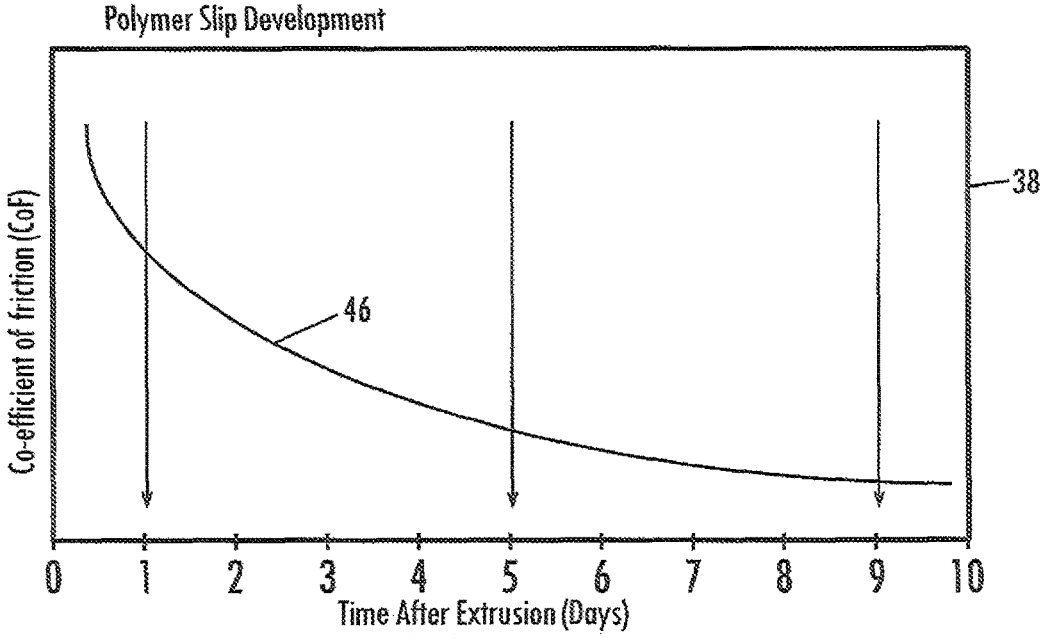
FIG. 4 is a plot of the coefficient of friction versus time after extrusion of the pile jacket material, regarding slip agent-impregnated material used in a pile jacket constructed in accordance with an embodiment of the present invention.
Figure 5A:
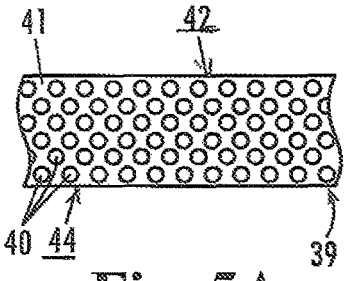
FIGS. 5A, 5B, and 5C are a simplified illustrations of a segment of slip agent-impregnated jacket material at, respectively, day one, day five, and day nine following extrusion, showing the progressive migration of an example slip agent to the surface of the material, forming a layer on the material.
Figure 5B:
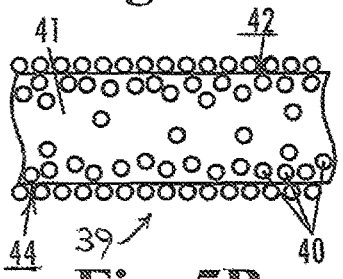
Figure 5C:
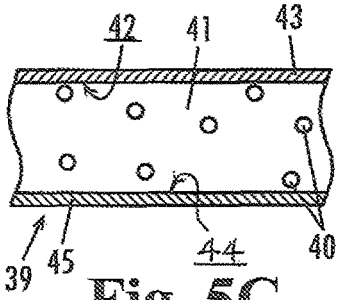

FIGS. 4 and 5A-5C illustrate the progressive decrease in the COF over time of a polyolefin sheet incorporating an amide additive. When slip additives are introduced into a thermoplastic extrusion process, they have a low compatibility with the polymer materials, allowing migration to the surface. FIG. 5A shows a segment 39 of a sheet of pile jacket material immediately (Day 1) after extrusion. Segment 39 includes polyolefin material 41 in which slip agent 40 is uniformly interspersed, and is shown having an upper exterior surface 42 and a lower exterior surface 44. FIG. 5B shows the segment 39 at Day 5 after extrusion, by which time the amide slip agent 40 has migrated to the exterior surfaces 42, 44 and begins to form a partial layer while friction rapidly drops, as demonstrated by the curve 46 of the plot 38 in FIG. 4. As shown in FIG. 5C, as the migration of the amide slip agent 40 reaches equilibrium, the layers of amide slip agent are mostly completely migrated, forming an upper exterior lubricating layer 43 and a lower exterior lubricating layer 45. FIG. 4 is a graph depicting the coefficient of friction being reduced as the amide slip agent 40 migrates over an illustrative time period of 10 days and into eventual equilibrium becoming stable. The slip agent 40 is incorporated within the polyolefin during the polymer mixing and/or extrusion processes.

The concentration of slip agent used can be, for example, about 1 wt % to about 2 wt % of the polymer. One skilled in the art can determine an appropriate concentration of slip agent for generating the desired end properties specified for the jacket. For example, one might want to also print company branding on the pile jacket, in which case the coefficient of friction should not be so low as to prevent printing inks from being applied and adhering to the exterior surface of a jacket. The slip agent used can, for example, be one commercially available from Croda International PLC, of East Yorkshire, United Kingdom, under the mark CRODAMIDE®.

EXAMPLE

Two types of polypropylene pile jacket materials were tested, namely: (1) a first-generation pile jacket sheet, with no slip agent additives, of the type disclosed in U.S. Pat. No. 4,721,418, and (2) a pile jacket sheet of the type disclosed herein, which includes an amide slip agent additive. Seven sheets of each type of material were cut and brought into contact with steel plates, which were previously unused, thus eliminating the effect of the plastic material rubbing off of the sheet onto the steel plate and affecting the results. For each set of data, the normal force applied included calibrated weights of 10 Kg (22.05 lb.), 20 Kg (44.09 lb.), and 30 Kg (66.14 lb.). The plates were advanced using a worm gear mechanical jacking apparatus, namely, the base of a Marshall testing machine, oriented in a horizontal position. The horizontal load applied was determined utilizing a calibrated load cell. The maximum load achieved prior to sliding was recorded for each normal force applied for each plate tested. The force required to slide the plate was divided by the normal force to arrive at a coefficient of sliding friction. The coefficients of sliding friction obtained for each trial were averaged. The following table summarizes the results:

| TYPE | AVG. COEFFICIENT OF SLIDING FRICTION |
|---|---|
| Conventional pile jacket sheet | 0.30 |
| Pile jacket sheet impregnated with amide slip agent additive | 0.26 |

The 0.04 difference between the two samples represents a 13.1% reduction in the coefficient of sliding friction achieved by the samples containing the amide slip agent additive.

The disclosed embodiment of the present invention encompasses several variations. For instance, although the disclosed pile jacket was discussed with reference to circular piles, the same concept can be applied to piles having different shapes, such as an H-shape cross section.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A friction reducing pile jacket comprising a sheet material conformable to surround and contact an exterior surface of a pile having a substantially uniform cross-sectional shape along at least a portion of its length, the sheet material formed from a thermoplastic polymer sheet and a slip agent, the slip agent forming a solid lubricating layer exterior to the thermoplastic polymer sheet, the pile jacket configured to engage a pile without any lubricant between the thermoplastic polymer sheet and the pile other than the solid lubricating layer.

2. The friction reducing pile jacket of claim 1, wherein the thermoplastic is a polyolefin.

3. The friction reducing pile jacket of claim 2, wherein the polyolefin comprises polypropylene.

4. The friction reducing pile jacket of claim 2, wherein the polyolefin comprises polyethylene.

5. The friction reducing pile jacket of claim 1, wherein the slip agent is an amide.

6. The friction reducing pile jacket of claim 5, wherein the amide is erucamide.

7. The friction reducing pile jacket of claim 5, wherein the amide is oleamide.

8. The friction reducing pile jacket of claim 1, wherein the slip agent is present in the sheet material at a concentration of about 1 wt % to about 2 wt % of the polymer.

9. The friction reducing pile jacket of claim 1, wherein:

the sheet material includes a longitudinal length and an interior surface engageable with the exterior surface of the pile; and the interior surface of the sheet material defines a plurality of scores along the longitudinal length.

10. The friction reducing pile jacket of claim 1, wherein:

the sheet material includes an exterior surface; and the sheet material has a coefficient of sliding friction of 0.26.

11. A method of shielding a pile from downward force exerted by backfilled earthen materials during settlement, the pile including an exterior surface and a substantially uniform cross sectional shape along at least a portion of its length, comprising the steps of:

driving the pile into soil, leaving a portion of the pile above the soil exposed, thereby defining an exposed portion of the pile;

wrapping a friction reducing pile jacket around an exterior surface of the exposed portion of the pile, the pile jacket constructed of sheet material formed from a thermoplastic polyolefin sheet and a slip agent, the slip agent forming a solid lubricating layer exterior to the thermoplastic polyolefin sheet, such that the solid lubricating layer contacts the exterior surface of the exposed portion of the pile without any other lubricant contacting the exterior surface of the exposed portion of the pile, thereby forming a jacketed section of the pile; and placing backfilled earthen materials around the jacketed section of the pile.

12. The method of claim 11, wherein the slip agent is an amide.

13. The method of claim 11, wherein the sheet material defines a longitudinal length and an interior surface, and wherein a plurality of scores are formed along the longitudinal length into the interior surface of the sheet material.

14. The method of claim 11, wherein the sheet material defines an exterior surface, and comprising the further steps of:

forming indentations in the exterior surface of the sheet material through its contact with the backfilled earthen materials; and preventing an interior surface of the sheet material from becoming indented;

wherein a first coefficient of sliding friction between the backfilled earthen materials and the exterior surface of the sheet material exceeds a second coefficient of sliding friction between the interior surface of the sheet material and the exterior surface of the pile, such that downward forces applied by settlement of the backfilled earthen materials tend to move the pile jacket downwardly about the pile substantially without transmitting a major portion of the downward forces to the pile thus creating and resulting in a slip plane effect between the settling backfilled earthen materials and the pile.

15. In combination, a pile having a substantially uniform cross-sectional shape along at least a portion of its length, and a pile jacket formed in a shape conforming to an exterior surface of the pile, the pile jacket formed from a thermoplastic polymer sheet and a slip agent, the slip agent forming a solid lubricating layer exterior to the thermoplastic polymer sheet, the pile jacket wrapped around the exterior surface of the pile without any lubricant between the thermoplastic polymer sheet and the exterior surface of the pile other than the solid lubricating layer.

* * * * *